United States Patent [19]

Bakalar

[11] Patent Number: 4,800,630

[45] Date of Patent: Jan. 31, 1989

[54] RELEASABLE FENCING APPARATUS

[76] Inventor: Michael J. Bakalar, Two Red Haw La., Lake Zurich, Ill. 60047

[21] Appl. No.: 129,596

[22] Filed: Dec. 7, 1987

[51] Int. Cl.[4] ..... B21F 27/00

[52] U.S. Cl. ..... 256/47; 256/1

[58] Field of Search ..... 256/1, 47, 32, 23, DIG. 2

[56] References Cited

U.S. PATENT DOCUMENTS 2,814,466 11/1957 Golobay ..... 256/32

3,089,681 5/1963 Smithwick ..... 256/47

3,239,195 3/1966 Todd et al. ..... 256/47 X

*Primary Examiner*—Andrew V. Kundrat

*Attorney, Agent, or Firm*—Leydig, Voit & Mayer

[57] ABSTRACT

A releasable fencing apparatus is disclosed which allows a substantially rigid supported fencing structure a degree of freedom at the bottom in order to allow easy access to the area underneath the fencing apparatus for purposes of grass cutting or trimming. A number of releasable clips are provided to detach a lower portion of the fencing fabric from the support structure. Several hinges allow a lower portion of the fencing fabric to swing away from its normal vertical position and its support structure. The invention may be easily implemented on conventional fencing apparatus.

8 Claims, 2 Drawing Sheets

RELEASABLE FENCING APPARATUS

FIELD OF THE INVENTION

The present invention relates generally to chain link fencing systems, and more particularly to chain link fencing systems used to enclose areas in a domestic environment.

BACKGROUND OF THE INVENTION

Chain link fencing systems are well known in the domestic environment for enclosing and separating individual residential property areas. The chain link fencing apparatus provides a certain amount of security while still not detracting from the aesthetic features of the surrounding environment. The fencing apparatus safeguards against small children from wandering away, and serves to allow pets access to the outdoors without getting lost. Fencing systems also prevent harmful confrontations between unfriendly pets, while also protecting residents and their guests from such unfriendly pets.

Chain link fencing systems are typically constructed by securing chain link fencing fabric to vertical support posts mounted firmly in the ground. The chain link fencing fabric itself is somewhat flexible, but when installed with various support elements, it assumes a rather rigid structure. The fence is usually positioned along a property line and defines a yard, with the chain link fencing fabric extending from the ground to the top of the vertical support posts. For convenient access to an area enclosed by the fence, gates are provided at entrances such as walkways and driveways.

As is evident, the purpose of chain link fencing apparatus is to provide a certain amount of security while still not detracting from the aesthetic character of the surrounding area. A chain link fencing system does, however, create difficulty in trimming lawns or shrubbery growing next to or underneath the chain link fencing fabric. This problem is particularly apparent in the rather typical situation where lawns extend continuously from one yard to the next with the fencing apparatus located in between. This situation creates an annoying interference for a lawn mower when the lawn in a yard is being cut. The presence of the chain link fencing fabric prevents the grass growing near and underneath the fence from being cut.

Although various devices have been developed in an attempt to alleviate this problem, the presence of the fencing fabric in the vicinity of the area to be trimmed still creates difficulties. Electric or gas powered trimmers have been designed to trim the grass or weeds growing next to obstacles. These devices operate by spinning a length of string, similar in quality to fishing line, at high speeds in order to sever blades of grass or small weeds upon contact. However, when the spinning string encounters an object of relatively substantial strength, such as the chain link fencing fabric, it has a tendency to recoil or break, thereby leaving the grass in the proximity of the object untouched. Thus, the grass near the fence remains and detracts from the aesthetic character of the surroundings.

SUMMARY OF THE INVENTION

It is a primary object of the present invention to provide a chain link fencing apparatus capable of reducing the aforementioned difficulty of trimming grass or shrubbery in the vicinity of the chain link fencing fabric.

It is a related object of the present invention to provide such a chain link fencing apparatus which does not detract from the aesthetic character of its surroundings.

It is a further object of the present invention to provide such a chain link fencing apparatus which may be easily and inexpensively implemented on conventional chain link fencing systems.

The above objects are realized in accordance with the present invention which provides a chain link fencing system capable of detaching and temporarily displacing a lower portion of the chain link fencing fabric from its normal stationary vertical position. This displacement is achieved through the use of hinge means and releasable attachment means which normally maintain the fence in its typical rigid condition, but which allow the lower portion of the fencing fabric to be swung away in an arcuate fashion from its normal vertical position. When this lower portion of the fencing fabric is displaced in this manner, access to the area underneath the fence is easily gained so as to allow shrub or grass trimming devices to properly operate in this area.

BRIEF DESCRIPTION OF THE DRAWINGS

Other objects and advantages of the invention will be apparent from the following detailed description and he accompanying drawings, in which.

DETAILED DESCRIPTION OF THE PREFERRED EMBODIMENT

Figure 1:
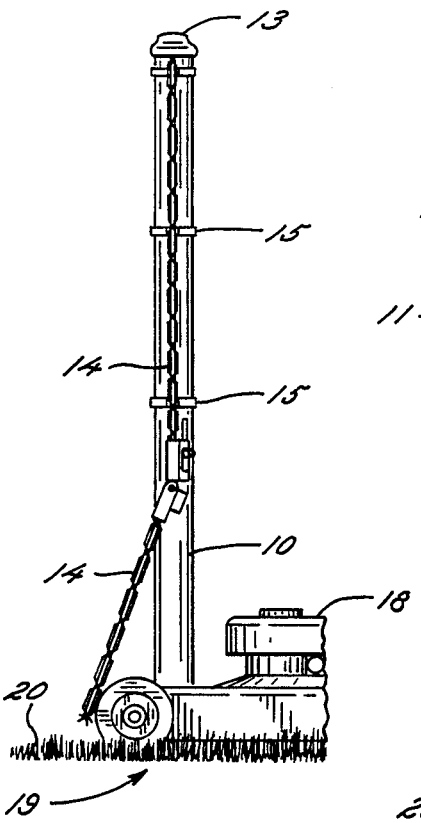
FIG. 1 is a side view of an embodiment of the fencing apparats exemplifying the present invention when operated

While the invention is susceptible to various modifications and alternative forms, specific embodiments thereof have been shown by way of example in the drawings and will be described in detail herein. It should be understood, however, that it is not intended to limit the invention to the particular forms disclosed, but, on the contrary, the intention is to cover all modifications, equivalents, and alternatives falling within the spirit and scope of the invention as defined by the appended claims. For example, references to chain link fencing herein are not intended to be limited to a particular style of fence, but instead are intended to encompass wire fencing systems formed of flexible fabric material but which when installed and stretched normally provide a reasonably stiff or rigid barrier.

Figure 2:
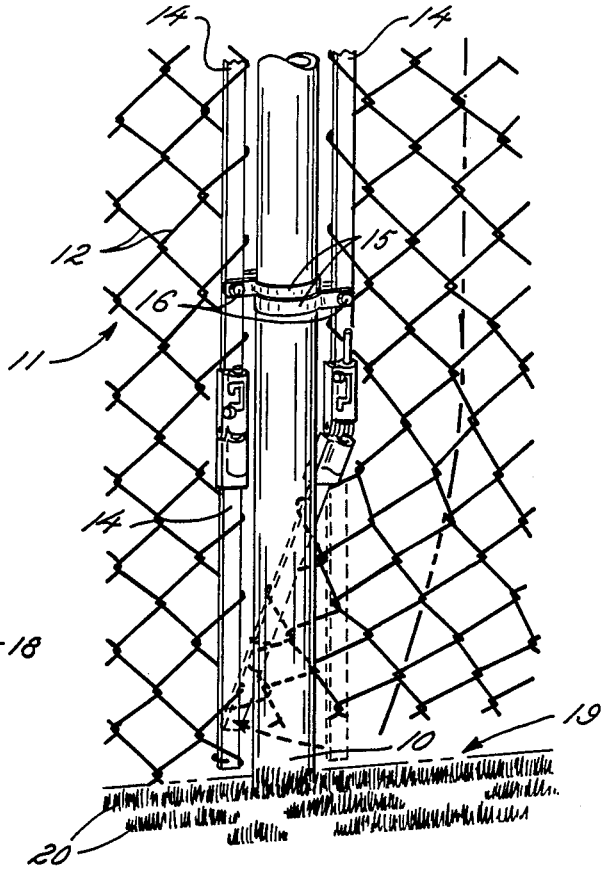
FIG. 2 is a perspective view of an embodiment of the fencing system according to the present invention which depicts the hinge and support apparatus as used on a terminal support post.
Figures 3A, 3B, 3C, 3D:
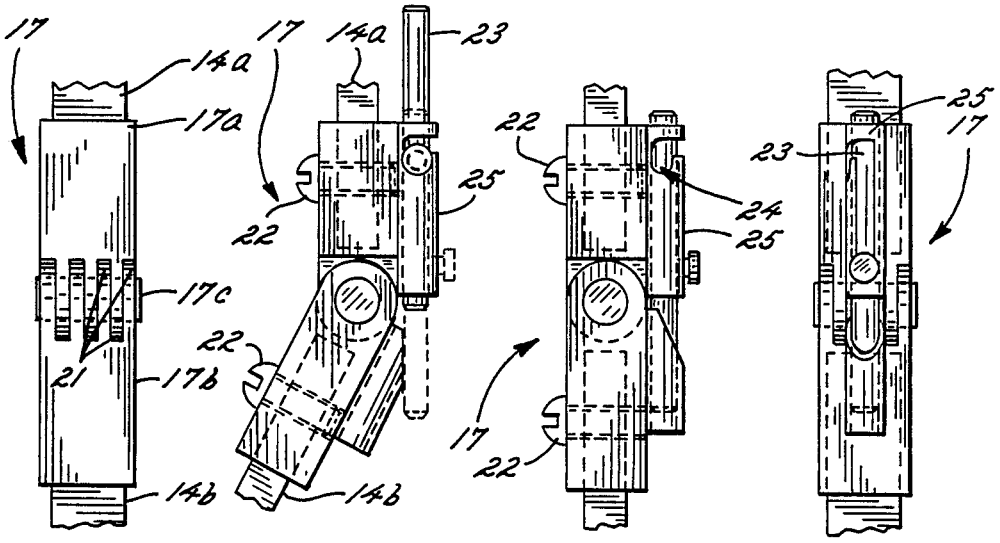
FIGS. 3A–3D are enlarged closeup views of an example of a hinge used in conjunction with the present invention.

Turning now to the drawings and referring first to FIGS. 1 and 2, there is shown a portion of a chain link fencing system exemplifying the present invention. In order to support the chain link fencing fabric 11, a terminal support post 10 is provided which is mounted in a vertical position and anchored firmly in the ground. The conventional chain link fencing material 11 is fabricated from individual strands of heavy gauge wire 12 woven together into a criss cross or grid pattern. The fencing material 11 by itself is rather flexible, but when secured into position and tensioned with various support means, it maintains a substantially rigid structure. When the fencing fabric 11 assumes its normal stationary vertical position, as on the left side of the terminal support post in FIG. 2, the fabric 11 extends from the ground level to the crown 13 of the terminal support post 10. In order to secure the chain link fencing fabric 11 to the terminal support post 10, there is provided fastener means, shown herein as a vertical support bar 14 interwoven with the fencing fabric 11 and fastened to the terminal support post 10 by a number of fastening straps 15. Any type of conventional fastening straps may be used for this purpose, such as the type depicted in FIG. 2 which fits snugly around the circumference of the terminal support post 10 and is mounted firmly to the vertical support bar 14 by rivets or small screws 16. As can be seen, the vertical support bar in conjuction with the fastening straps 15 provide a means for securely fastening the chain link fencing fabric 11 between the terminal support posts 10.

In accordance with an important aspect of the invention, the rather rigid supported fencing structure is granted a degree of freedom at the bottom such as by use of a hinge device 17 associated with the vertical support bar 14. At some point along the length of the terminal support 10, a hinge 17 is provided which allows the portion of the fence fabric 11 and support bar 14 located below the pivot point of the hinge 17 to swing away from its normal vertical position, as shown in FIG. 1 and on the right side of the terminal support post 10 in FIG. 2. In a preferred embodiment of the invention, the hinge device 17 is positioned about twelve to eighteen inches above the ground. As can be seen in FIG. 1, when this lower portion of the fence is swung away from its normal vertical position, free access to the area underlying the fence is easily gained for trimming devices such as a lawn mower 18. When the lower fence portion is in its remote position (swung away from its normal vertical position as in FIG. 1), the chain link fencing fabric 11 no longer interferes with the area underneath the fence 19, thus creating an area free of obstacles in order to efficiently trim grass 20, weeds or accomplish other minor landscaping in the previously inaccessable vicinity of the lower fence portion.

Turning now to FIGS. 3A–3D, there is shown a hinge 17 which is incorporated in the vertical support bar 14. The hinge 17 provides a pivot point for the vertical support bar 14 which allows it to swing. As can be seen, the vertical support bar 14 is comprised of two sections—an upper support bar section **14*a* which remains firmly mounted to the terminal support post 10, and a lower support bar section 14*b* which is not attached to the terminal support post 10 and which may swing away, via operation of the hinge 17**, from its normal vertical position.

The hinge 17 is comprised of a number of interleaved tongues 21 extending from upper **17*a* and lower 17*b* hinge sections around a circular pivot member 17*c*. The upper 14*a* and lower 14*b* vertical support bar sections are fitted in respective upper and lower cavities in the hinge 17 and are secured by small screws 22. A locking bar 23 is provided on the hinge 17 to retain the hinge 17 and the vertical support bar 14 when in its normal vertical position. When it is desired to swing the lower fence portion, the locking bar 23 is moved to its upper unlocked position, and is retained in this position by a recess 24 in the locking bar guide 25. As shown in dashed lines in FIG. 3B, the locking bar 23 may be lowered to engage the beveled end of the guide 25 when the lower fence portion is swung out to lock the fence in that position. When it is desired to lock the lower fence portion in its vertical position, the locking bar 23 is inserted into the lower portion of the locking bar guide 25, thus preventing any movement of the hinge 17** and lower fence portion.

Figure 5:
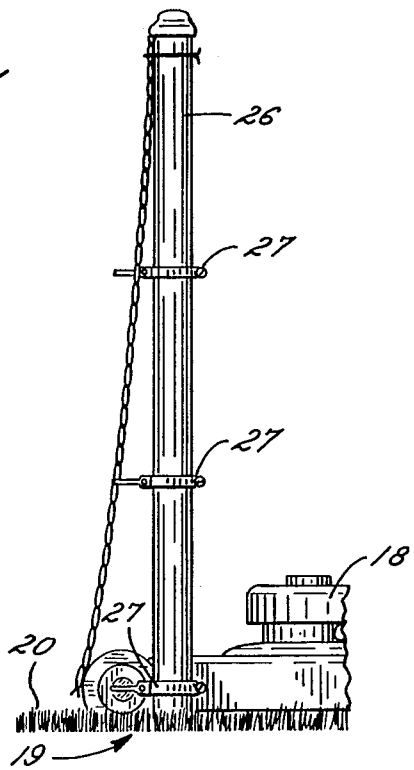
FIG. 5 is a side view of an intermediate support post and chain link fencing fabric according to an example of the present invention when operated during lawn cutting.
Figure 4:
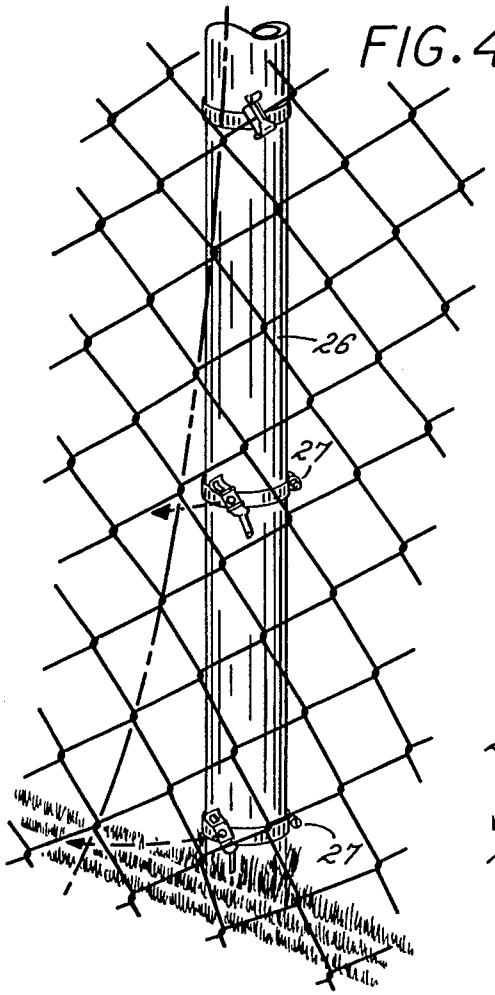
FIG. 4 is a perspective view of an intermediate support post as used in accordance with an embodiment of the present invention.

In addition to a number of terminal support posts, the typical fencing system also uses a number of intermediate support posts to support long stretches of chain link fencing fabric between the terminal support posts and to maintain the rigidity of the fencing system along its length. Referring to FIGS. 4 and 5, there is shown an intermediate support post 26 as modified in accordance with the present invention. A number of releasable clips 27 are mounted along the length of the intermediate support post 26 in order to attach the chain link fencing fabric 11 to the intermediate support post 26. Preferably, there will also be a permanent clip mounted near the top of the intermediate support post 26 which firmly retains and supports the chain link fencing fabric 11. When the chain link fencing fabric 11 assumes its normal vertical position, each of the releasable clips 27 is closed, retaining the fencing fabric 11 against the intermediate support post 26. When in this position the chain link fencing fabric, supported by the terminal and intermediate support posts and vertical support bars, maintains a substantially rigid structure.

When it is desired to swing the fence away from its normal vertical position, the releasable clips 27 are flipped to their open position, allowing the fencing fabric 11 to swing freely from the intermediate support post 26. In this position away from the intermediate support post 26, the fencing fabric 11 no longer interferes with the area under the fence 19, thus facilitating access for trimming devices such as a lawn mower 18. Typically, only the bottom one or two releasable clips 27 need to be opened in order to sufficiently free a lower portion of the fence, although, all of the releasable clips 27 may be opened in order to provide for the longest possible swing path from the intermediate support post.

Figure 6A:
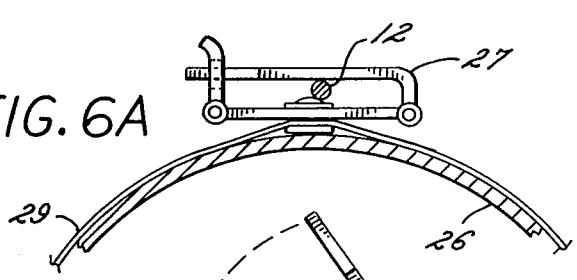
FIGS. 6A and 6B depict the open and closed positions, respectively, of a releasable clip used in conjunction with an intermediate support post according to an example of the present invention.
Figure 6B:
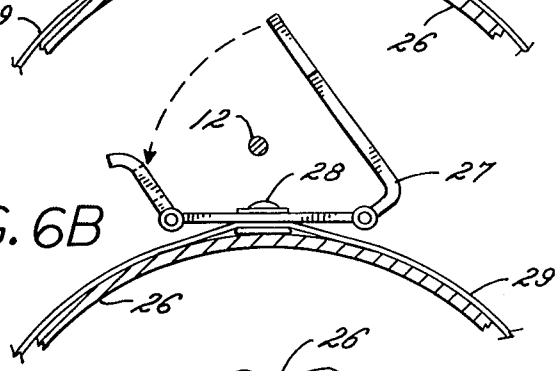

Referring now to FIGS. 6A and 6B, there is shown a releasable clip 27 used in conjunction with the intermediate support post 26. A rivet 28 is used to attach the clip 27 to a band 29 which is tightly secured to the intermediate support post 26. Any conventional type of suitable releasable clip may be used, but a particular three-part releasable clip is described herein as an example.

Figure 7:
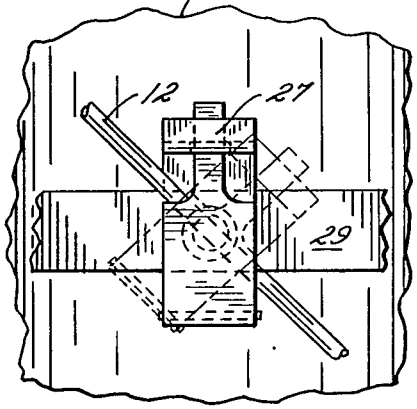
FIG. 7 is a top view depicting the rotational movement of the releasable clip of FIGS. 6A and 6B.

The clip 27 used in conjunction with the preferred embodiment of the present invention may be rotated on the axis of the rivet 28. According to an important aspect of the invention, this allows the clip 27 to accommodate and retain a chain link fencing wire 12 at any angle. Preferably, the clip 27 will be rotated to an angle generally perpendicular to that of the fencing wire 12 to be received, as shown in FIG. 7. In this regard, the rivet 28 used to attach the clip 27 should be of the type which facilitates rotation so as to allow the proper orientation of the clip 27 in relation to the fencing wire 12 to be retained.

When the chain link fencing material 11 is to be secured in its normal vertical position, the clip 27 will be closed, retaining one of the chain link fencing wires 12. Preferably, the dimension of the clip 27 is such that when in its closed state, the retaining section is comparable to the diameter of the fencing wire 12. Thus, the fencing wire 12 will be held firmly in place by the clip 27, as shown in FIG. 6A. When it is desired to swing the fencing material 11 away from its normal vertical position, such as to trim the grass 20 underneath the fence, the clip 27 is placed in its open position and the fencing wire 12 is freed from within the grasp of the clip 27, as illustrated in FIG. 6B.

As can be seen from the foregoing detailed description, this invention provides a releasable chain link fencing apparatus which allows a lower portion of the chain link fencing material to be temporarily displaced from its normal vertical position. This displacement allows grass cutting and shrubbery trimming devices substantially free access to the area located directly beneath the fence. The invention may be easily implemented on conventional chain link fencing systems, and does not detract from the aesthetic character of the surrounding area.

What is claimed is:

1. A chain link fencing system comprising, two or more spaced apart vertical terminal support posts, one or more vertical intermediate support posts positioned between said terminal support posts, chain link fencing fabric mounted between said terminal support posts, fastener means for fastening said fencing fabric between said terminal support posts, hinge means operatively associated with said fastener means for allowing a lower portion of said fencing fabric to swing away in an arcuate fashion from said terminal support posts, and a plurality of releasable clip means located along the length of said intermediate support posts for selectively and releasably fastening portions of said fencing fabric to said intermediate support posts, thereby allowing a lower portion of said fencing fabric to be released from said intermediate support posts and swing away from said intermediate support posts and said terminal support posts.

2. The chain link fencing system according to claim 1 wherein each of said releasable clip means is fully circularly rotatable with respect to the vertical plane defined by said chain link fencing fabric.

3. A chain link fencing system comprising, two or more spaced apart vertical terminal support posts, chain link fencing fabric mounted between said terminal support posts, vertical support means for fastening said fencing fabric between said terminal support posts, said vertical support means having an upper portion secured to said terminal support posts, hinge means operatively associated with said vertical support means and interposed between said upper portion and a lower portion of said vertical support means for allowing said lower portion of said vertical support means and the associated lower portion of said fencing fabric to swing away from said terminal support posts.

4. The chain link fencing system according to claim 3 further comprising, one or more vertical intermediate support posts positioned between said terminal support posts, a plurality of releasable clip means located along the length of said intermediate support posts for selectively and releasably fastening portions of said fencing fabric to said intermediate support posts, thereby allowing a lower portion of said fencing fabric to swing away in an arcuate fashion from said intermediate support posts.

5. The chain link fencing system according to claim 4 wherein each of said releasable clip means is fully circularly rotatable with respect to the vertical plane defined by said chain link fencing fabric.

6. The chain link fencing system according to claim 3 further comprising, locking means operatively associated with said hinge means for retaining said hinge means in a predetermined position whereby said fencing fabric is maintained in a substantially vertical position.

7. The chain link fencing system according to claim 3 further comprising, locking means operatively associated with said hinge means for retaining said hinge means in a predetermined position whereby said lower portion of said fencing fabric is maintained in a position angling away from said terminal support posts.

8. The chain link fencing system according to claim 3 wherein said vertical support means comprises a substantially vertically positioned support bar interwoven with said fencing fabric, said hinge means is attached to said support bar and defines an upper portion and a lower portion of said support bar, said upper portion of said support bar is fastened to said terminal support post by a number of straps attached to said terminal support post, and said lower portion of said support bar is associated with said lower portion of said fencing fabric.

* * * * *